US008237651B2

(12) United States Patent
Hasegawa et al.

(10) Patent No.: US 8,237,651 B2
(45) Date of Patent: Aug. 7, 2012

(54) TEMPERATURE CONTROL METHOD FOR DISPLAY DEVICE AND DISPLAY DEVICE

(75) Inventors: Hiroshi Hasegawa, Kanagawa (JP); Daisuke Kondo, Saitama (JP)

(73) Assignee: Sony Corporation, Tokyo (JP)

( * ) Notice: Subject to any disclaimer, the term of this patent is extended or adjusted under 35 U.S.C. 154(b) by 745 days.

(21) Appl. No.: 11/984,816

(22) Filed: Nov. 21, 2007

(65) Prior Publication Data

US 2008/0143652 A1 Jun. 19, 2008

(30) Foreign Application Priority Data

Dec. 19, 2006 (JP) ..... 2006-341064

(51) Int. Cl.
*G09G 3/36* (2006.01)
*G09G 3/30* (2006.01)

(52) U.S. Cl. ..... 345/101; 345/77

(58) Field of Classification Search ..... 345/77, 345/100, 101, 76

See application file for complete search history.

(56) References Cited

U.S. PATENT DOCUMENTS

| | | | | |
|---|---|---|---|---|
| 5,880,780 | A * | 3/1999 | Sekiguchi | 348/241 |
| 6,297,791 | B1 * | 10/2001 | Naito et al. | 345/89 |
| 6,496,168 | B1 * | 12/2002 | Tomida | 345/76 |
| 6,509,884 | B2 * | 1/2003 | Kasahara et al. | 345/63 |
| 6,683,584 | B2 * | 1/2004 | Ronzani et al. | 345/8 |
| 6,831,621 | B2 * | 12/2004 | Nakano | 345/87 |
| 6,975,068 | B2 * | 12/2005 | Green et al. | 313/582 |
| 7,088,312 | B2 * | 8/2006 | Ishizuka et al. | 345/60 |
| 7,109,990 | B1 * | 9/2006 | Oler et al. | 345/428 |
| 7,136,043 | B2 * | 11/2006 | Mori et al. | 345/101 |
| 2004/0128101 | A1 * | 7/2004 | Hermerding, II | 702/136 |
| 2004/0201564 | A1 * | 10/2004 | Sugino et al. | 345/101 |
| 2005/0128169 | A1 * | 6/2005 | Kang et al. | 345/87 |
| 2005/0231449 | A1 * | 10/2005 | Miyagawa | 345/77 |
| 2006/0146005 | A1 * | 7/2006 | Baba et al. | 345/102 |
| 2006/0152454 | A1 * | 7/2006 | Cok et al. | 345/82 |
| 2007/0165058 | A1 * | 7/2007 | Tamura et al. | 347/17 |

FOREIGN PATENT DOCUMENTS

| | | |
|---|---|---|
| JP | 2002-175046 | 6/2002 |
| JP | 2005-031430 | 2/2005 |

* cited by examiner

*Primary Examiner* — Alexander Eisen
*Assistant Examiner* — Mark Regn
(74) *Attorney, Agent, or Firm* — Rader Fishman & Grauer, PLLC

(57) ABSTRACT

A method of controlling the temperature of a display device which includes a display panel having a plurality of light emitting elements arrayed in a matrix form, and a plurality of driver ICs is disclosed. The method includes the steps of: generating temperature information of the driver IC by detecting an exothermic temperature caused by the consumption power of each of the driver ICs; and controlling a supply current to the light emitting elements by comparing the temperature information with temperature information added with weighted position information to perform weighting in such a manner that exothermic temperature detection data of the driver IC becomes larger for the driver IC corresponding to an upper area of the display panel by using a look-up table previously formed and stored.

21 Claims, 15 Drawing Sheets

FIG. 6

| | | | | | | | | | | | | | | | | | |
|---|---|---|---|---|---|---|---|---|---|---|---|---|---|---|---|---|---|
| INPUT TEMPERATURE INFORMATION | DETECTED TEMPERATURE DATA OF GATE DRIVER IC3a | 0 | 1 | 0 | 1 | 0 | 1 | 0 | 1 | 0 | 1 | 0 | 1 | 0 | 1 | 0 | 1 |
| | DETECTED TEMPERATURE DATA OF GATE DRIVER IC3b | 0 | 0 | 1 | 1 | 0 | 0 | 1 | 1 | 0 | 0 | 1 | 1 | 0 | 0 | 1 | 1 |
| | DETECTED TEMPERATURE DATA OF GATE DRIVER IC3c | 0 | 0 | 0 | 0 | 1 | 1 | 1 | 1 | 0 | 0 | 0 | 0 | 1 | 1 | 1 | 1 |
| | DETECTED TEMPERATURE DATA OF GATE DRIVER IC3d | 0 | 0 | 0 | 0 | 0 | 0 | 0 | 0 | 1 | 1 | 1 | 1 | 1 | 1 | 1 | 1 |
| WEIGHTED TEMPERATURE INFORMATION | DETECTED TEMPERATURE DATA OF GATE DRIVER IC3a | 0.0 | 1.2 | 0.0 | 1.2 | 0.0 | 1.2 | 0.0 | 1.2 | 0.0 | 1.2 | 0.0 | 1.2 | 0.0 | 1.2 | 0.0 | 1.2 |
| | DETECTED TEMPERATURE DATA OF GATE DRIVER IC3b | 0.0 | 0.0 | 1.1 | 1.1 | 0.0 | 0.0 | 1.1 | 1.1 | 0.0 | 0.0 | 1.1 | 1.1 | 0.0 | 0.0 | 1.1 | 1.1 |
| | DETECTED TEMPERATURE DATA OF GATE DRIVER IC3c | 0.0 | 0.0 | 0.0 | 0.0 | 1.0 | 1.0 | 1.0 | 1.0 | 0.0 | 0.0 | 0.0 | 0.0 | 1.0 | 1.0 | 1.0 | 1.0 |
| | DETECTED TEMPERATURE DATA OF GATE DRIVER IC3d | 0.0 | 0.0 | 0.0 | 0.0 | 0.0 | 0.0 | 0.0 | 0.0 | 0.9 | 0.9 | 0.9 | 0.9 | 0.9 | 0.9 | 0.9 | 0.9 |
| TEMPERATURE PROCESSING DATA (TOTAL BIT) | | 0.0 | 1.2 | 1.1 | 2.3 | 1.0 | 2.2 | 2.1 | 3.3 | 0.9 | 2.1 | 2.0 | 3.2 | 1.9 | 3.1 | 3.0 | 4.2 |

FIG. 10

| | | | | | | | | | | | | | | | | | |
|---|---|---|---|---|---|---|---|---|---|---|---|---|---|---|---|---|---|
| TEMPERATURE INFORMATION | DETECTED TEMPERATURE DATA OF GATE DRIVER IC3a | 0 | 1 | 0 | 1 | 0 | 1 | 0 | 1 | 0 | 1 | 0 | 1 | 0 | 1 | 0 | 1 |
| | DETECTED TEMPERATURE DATA OF GATE DRIVER IC3b | 0 | 0 | 1 | 1 | 0 | 0 | 1 | 1 | 0 | 0 | 1 | 1 | 0 | 0 | 1 | 1 |
| | DETECTED TEMPERATURE DATA OF GATE DRIVER IC3c | 0 | 0 | 0 | 0 | 1 | 1 | 1 | 1 | 0 | 0 | 0 | 0 | 1 | 1 | 1 | 1 |
| | DETECTED TEMPERATURE DATA OF GATE DRIVER IC3d | 0 | 0 | 0 | 0 | 0 | 0 | 0 | 0 | 1 | 1 | 1 | 1 | 1 | 1 | 1 | 1 |
| TEMPERATURE PROCESSING DATA (TOTAL BIT) | | 0 | 1 | 1 | 2 | 1 | 2 | 2 | 3 | 1 | 2 | 2 | 3 | 2 | 3 | 3 | 4 |

TEMPERATURE CONTROL METHOD FOR DISPLAY DEVICE AND DISPLAY DEVICE

BACKGROUND OF THE INVENTION

1. Field of the Invention

The present invention relates to a display device having a plurality of light emitting elements arrayed in a matrix form on a display panel, the luminance of each light emitting element being controlled by a current value, and more particularly to a temperature control method for a display device and a display device capable of controlling the temperature of a display panel with a simple configuration.

2. Description of Related Art

In a display device having a large number of light emitting elements arrayed in a matrix form on a display panel, with the luminance of each light emitting element being controlled by a current value, it is generally required to increase a value of current to be supplied to each light emitting element in order to obtain a high luminance. However, as the current value is increased, the light emitting element generates heat, shortening the lifetime of the element.

An emission efficiency of a light emitting element has improved in recent years, and a signal level in an ordinary image display state is reduced by more than half of the signal level presenting a maximum luminance. The lifetime of a light emitting element is therefore rarely shortened by heat generation. However, for example, in the worst state in which a full white display state continues for a long time, a light emitting element may generate heat and be damaged.

In order to settle this issue, there has been proposed a display device in which an operational environment temperature of a display panel is detected, and when this temperature exceeds a predetermined temperature (e.g., 50° C.), the drive voltage value of a light emitting element is changed and each light emitting element is driven to make the luminance value of the light emitting element lower than a predetermined luminance value (e.g., refer to Japanese Unexamined Patent Application Publication No. 2005-31430(hereinafter referred to as "Patent Document 1")).

In another display device, a temperature detector is provided to each of a plurality of organic electro luminescence elements (hereinafter called "organic EL element") serving as light emitting elements and arrayed in a matrix form, and emission control of each organic EL element is performed by using temperature data detected with each temperature detector (e.g., refer to Japanese Unexamined Patent Application Publication No. 2002-175046(hereinafter referred to as "Patent Document 2")).

SUMMARY OF THE INVENTION

Of known display devices, the display device described in the Patent Document 1 detects the operational environment temperature of the display panel. Therefore, a change in the operational environment temperature is small, for example, even if the light emitting elements generate heat because a full white display state continues, and it is difficult to immediately detect a temperature rise in the light emitting elements. It is therefore difficult to perform an efficient temperature control of the display panel and suppress the light emitting elements from being damaged by heat generation.

The display device described in Patent Document 2 provides a temperature detector to each of the number of organic EL elements. Therefore, although a temperature rise in the organic EL elements can be detected immediately and controlled properly, there is a fear that the structure becomes complicated and the cost of the display device rises.

The present invention addresses the above-described issue and provides a display device capable of efficiently controlling the temperature of a display panel with a simple configuration.

In accordance with a first aspect of the present invention, there is provided a method of controlling the temperature of a display device which includes a display panel having a plurality of light emitting elements arrayed in a matrix form, the luminance of each light emitting element being controlled by a current value, and a plurality of driver ICs, each of which is provided to correspond to each area of the display panel divided along a horizontal direction to perform a current drive of the light emitting elements in each divided area, including the steps of: generating temperature information of the driver IC by detecting an exothermic temperature caused by the consumption power of each of the driver ICs; and controlling a supply current to the emitting elements by comparing the temperature information with temperature information added with weighted position information to perform weighting in such a manner that exothermic temperature detection data of the driver IC becomes larger for the driver IC corresponding to an upper area of the display panel, by using a look-up table previously formed and stored.

With this arrangement, the temperature information of the driver IC is generated by detecting an exothermic temperature of the driver IC provided in each of a plurality of areas dividing the display panel in a horizontal direction to perform a current drive of the light emitting element in each area. A supply current to the light emitting elements is controlled by comparing the generated temperature information with the temperature information added with weighted position information for performing weighting in such a manner that detection data of an exothermic temperature of the driver IC becomes larger for the driver IC corresponding to an upper area of the display panel, by using the look-up table previously formed and stored.

In accordance with a second aspect of the present invention, there is provided a method of controlling the temperature of a display device which includes a display panel having a plurality of light emitting elements arrayed in a matrix form, the luminance of each light emitting element being controlled by a current value, and a plurality of driver ICs, each of which is provided to correspond to each of a plurality of areas of the display panel divided along a horizontal direction to perform a current drive of the light emitting elements in each divided area, including the steps of: generating temperature information added with weighted position information of the driver IC for performing weighting in such a manner that detection data of an exothermic temperature caused by the consumption power of the driver IC becomes larger for the driver IC corresponding to an upper area of the display panel; and controlling a supply current to the light emitting elements by comparing the temperature information with the weighted position information with temperature information in a look-up table previously formed and stored.

With this arrangement, the temperature information with added position information of the driver IC provided in each of a plurality of areas dividing the display panel in a horizontal direction to perform a current drive of each light emitting element in each divided area is generated by performing weighting in such a manner that detection data of an exothermic temperature caused by the consumption power of the driver IC becomes larger for the driver IC corresponding to an upper area of the display panel, and the supply current to the light emitting elements is controlled by comparing the temperature information added with the position information with temperature information in the look-up table previously formed and stored.

In accordance with a third aspect of the present invention, there is provided a display device including: a display panel having a plurality of light emitting elements arrayed in a matrix form, the luminance of each light emitting element being controlled by a current value, and a plurality of driver ICs, each of which is provided to correspond to each of a plurality of areas of the display panel divided along a horizontal direction to perform a current drive of the light emitting elements in each divided area; detecting means for detecting an exothermic temperature caused by consumption power of each of the driver ICs and generating temperature information of the driver IC; and an image processing circuit for controlling a supply current to the light emitting elements by comparing the temperature information with temperature information added with weighted position information for performing weighting in such a manner that exothermic temperature detection data of the driver IC becomes larger for the driver IC corresponding to an upper area of the display panel, by using a look-up table previously formed and stored.

With this arrangement, the detecting means generates the temperature information by detecting the exothermic temperature caused by the consumption power of the driver IC provided to correspond to each of a plurality of areas of the display panel divided along a horizontal direction into a plurality of areas to perform a current drive of the light emitting elements in each divided area. Then, the image processing circuit controls the supply current to the light emitting elements by comparing the temperature information with temperature information added with weighted position information for performing weighting in such a manner that exothermic temperature detection data of the driver IC becomes larger for the driver IC corresponding to an upper area of the display panel, by using the look-up table previously formed and stored.

In accordance with a fourth aspect of the present invention, there is provided a display device including: a display panel having a plurality of light emitting elements arrayed in a matrix form, the luminance of each light emitting element being controlled by a current value; a plurality of driver ICs, each of the driver ICs being provided to correspond to each of a plurality of areas of the display panel divided along a horizontal direction to perform a current drive of the light emitting elements in each divided areas; detecting means for generating temperature information added with weighted position information for performing weighting in such a manner that detection data of an exothermic temperature caused by consumption power of the driver IC becomes larger for the driver IC corresponding to an upper area of the display panel; and an image processing circuit for controlling a supply current to the light emitting elements by comparing the temperature information with the weighted position information with temperature information in a look-up table previously formed and stored.

With this arrangement, the detection means generates the temperature information with added position information of the driver IC provided to correspond to each of a plurality of areas of the display panel divided along a horizontal direction to perform a current drive of the light emitting elements in each divided area, by performing weighting in such a manner that detection data of an exothermic temperature caused by consumption power of the driver IC becomes larger for the driver IC corresponding to an upper area of the display panel. Then, the image processing circuit controls the supply current to the light emitting elements by comparing the temperature information added with the position information with the temperature information in the look-up table previously formed and stored.

According to the method of controlling the temperature of a display device by the first aspect of the present invention, heat generation of the light emitting elements can be detected immediately as the exothermic temperature caused by the consumption power of the driver IC. It is therefore possible to efficiently perform temperature control of a display panel whose temperature is raised by the heat generation of the light emitting elements. Further, since the exothermic temperature caused by the consumption power of the driver IC is detected, it is unnecessary to provide a temperature detector to each of the light emitting elements arrayed in a matrix form, as known in the art, and it is possible to simplify the structure of the temperature detecting means for outputting temperature information by detecting the exothermic temperature of the driver IC. Further, the supply current to the light emitting elements is controlled by comparing the temperature information with the temperature information added with weighted position information for performing weighting in such a manner that detection data of an exothermic temperature of the driver IC becomes larger for the driver IC corresponding to an upper area of the display panel, with the temperature information of the driver IC, by using the look-up table previously formed and stored. It is therefore possible to perform proper temperature control even in a state in which the temperature distribution in a plane of the display panel becomes irregular depending upon the mechanical condition and use condition of the display panel. In this case, since weight setting can be realized in a software manner, weighting can be changed easily, so that an increase in cost of the display device can be suppressed.

According to the method of controlling the temperature of a display device by the second aspect of the present invention, heat generation of the light emitting elements can be detected immediately as the exothermic temperature caused by the consumption power of the driver IC. It is therefore possible to efficiently perform temperature control of a display panel whose temperature is raised by heat generation of the light emitting elements. Further, since the exothermic temperature caused by the consumption power of the driver IC is detected, it is unnecessary to provide a temperature detector to each of the light emitting elements arrayed in a matrix form, as known in the art, and it is possible to simplify the structure of the temperature detecting means for outputting temperature information by detecting an exothermic temperature of the driver IC. Further, the supply current to the light emitting elements is controlled by comparing the temperature information in the look-up table previously formed and stored with the temperature information added with weighted position information for performing weighting in such a manner that detection data of an exothermic temperature of the driver IC becomes larger for the driver IC corresponding to an upper area of the display panel. It is therefore possible to perform proper temperature control even in a state in which the temperature distribution in a plane of the display panel becomes irregular depending upon the mechanical condition and use condition of the display panel. In this case, since weight setting can be realized in a hardware manner, an adjustment of temperature control of display devices can be made independently.

The temperature information of the driver IC generating step may be performed by detecting a consumption power of the driver IC in a consumption power detector circuit provided in a driver current input portion. According to the temperature information generating step, the temperature information may be generated by detecting an exothermic temperature of the driver IC having a high correlation with the consumption power of the driver IC. It is therefore possible to perform temperature control of the display panel using the temperature information generated by detecting the exothermic temperature of the driver IC.

The temperature information of the driver IC generating step may be performed by detecting a consumption power of the driver IC in a consumption power detector circuit provided in a drive current input portion. According to the temperature information generating step, the temperature information of the driver IC may be generated by detecting the power consumption of the driver IC directly. It is therefore possible to improve a detection efficiency of the consumption power of the driver IC and improve further a control efficiency of the temperature of the display panel.

According to the display device by the second aspect of the present invention, heat generation of the light emitting elements may be detected immediately as the exothermic temperature caused by the consumption power of the driver IC. It is therefore possible to efficiently perform temperature control of a display panel whose temperature is raised by heat generation of the light emitting elements. Further, since the exothermic temperature caused by the consumption power of the driver IC is detected, it is unnecessary to provide a temperature detector to each of the light emitting elements arrayed in a matrix form, as known in the art, and it is possible to simplify the structure of the temperature detecting means for outputting temperature information by detecting the exothermic temperature of the driver IC. Further, it is not necessary to mount a temperature sensor or the like on the display panel. Therefore, the temperature sensor or the like does not hinder thinning the display panel. This is effective for an organic EL display panel characterized mainly in thinning. Further, the supply current to the light emitting elements is controlled by comparing the temperature information with the temperature information added with weighted position information for performing weighting in such a manner that detection data of an exothermic temperature of the driver IC becomes larger for the driver IC corresponding to an upper area of the display panel, with the temperature information of the driver IC, by using the look-up table previously formed and stored. It is therefore possible to perform proper temperature control even in a state in which the temperature distribution in a plane of the display panel becomes irregular depending upon the mechanical condition and use condition of the display panel. In this case, since weight setting can be realized in a software manner, weighting can be changed easily, so that an increase in cost of the display device can be suppressed.

According to the display device by the forth aspect of the present invention, heat generation of the light emitting elements may be detected immediately as the exothermic temperature caused by the consumption power of the driver IC. It is therefore possible to efficiently perform temperature control of a display panel whose temperature is raised by heat generation of the light emitting elements. Further, since the exothermic temperature caused by the consumption power of the driver IC is detected, it is unnecessary to provide a temperature detector to each of the light emitting elements arrayed in a matrix form, as known in the art, and it is possible to simplify the structure of the temperature detecting means for outputting temperature information by detecting the exothermic temperature of the driver IC. Further, it is not necessary to mount a temperature sensor or the like on the display panel. Therefore, the temperature sensor or the like does not hinder thinning the display panel. This is effective for an organic EL display panel characterized mainly in thinning. Further, the supply current to the light emitting elements is controlled by obtaining the temperature information added with weighted position information for performing weighting in such a manner that exothermic temperature detection data of the driver IC becomes larger for the driver IC corresponding to an upper area of the display panel, and comparing the obtained temperature information added with weighted position information with the temperature information in the look-up table previously formed and stored. It is therefore possible to perform proper temperature control even in a state in which the temperature distribution in a plane of the display panel becomes irregular depending upon the mechanical condition and use condition of the display panel. In this case, since weight setting can be realized in a hardware manner, an adjustment of temperature control of display devices can be made independently.

The detecting means may include a thermosensitive unit for detecting the exothermic temperature of the drive IC. By employing the thermosensitive unit, the power consumption of the driver IC may be detected as the exothermic temperature of the driver IC. It is therefore possible to perform temperature control of the display panel by detecting the exothermic temperature of the driver IC.

The thermosensitive unit may be a diode structure changing a forward voltage drop with a temperature. The thermosensitive unit may be employed to design in such a manner that a temperature rise in the driver IC becomes equal to a temperature rise in the thermosensitive unit of the temperature detecting means. Further, since the thermosensitive unit may be formed at the same time when the driver IC is manufactured, the number of components and the number of assembly processes can be reduced. Furthermore, since the thermosensitive unit may be formed at the same time when the driver IC is manufactured, the temperature detection sensitivity of the driver IC and the temperature control precision of the display panel can be improved.

The detecting means may include a consumption power detecting circuit in a drive current input portion of the drive IC. By employing the detecting means, the temperature information of the driver IC may be generated by directly detecting the consumption power of the driver IC. It is therefore possible to improve the detection efficiency of the consumption power of the driver IC and further improve the control efficiency of a temperature of the display panel.

The image processing circuit may control a supply current to the light emitting elements by controlling one or both of an amplification factor for image data and an emission time of the light emitting elements. By employing the processing circuit, the supply current to the light emitting elements may be controlled by an amplification factor for the image data and an emission time of the light emitting elements, so that a temperature rise in the display panel can be suppressed by suppressing the heat generation of the light emitting elements.

The light emitting element may be an organic electro luminescence element. By employing the organic electro luminescence element, the destruction of the organic EL elements that may be caused by thermorunaway may be prevented, and the lifetime of the display panel may be prolonged.

BRIEF DESCRIPTION OF THE DRAWINGS

FIG. 6 is an illustrative diagram showing an example of the structure of a look-up table to be used for temperature control of the display panel.

FIG. 8A illustrates temperature control by adjusting an amplification factor for image data; and FIG. 8B illustrates temperature control by adjusting an emission time.

FIG. 10 is an illustrative diagram showing another example of the structure of the look-up table shown in FIG. 6.

DETAILED DESCRIPTION OF THE EMBODIMENTS

Figure 1:
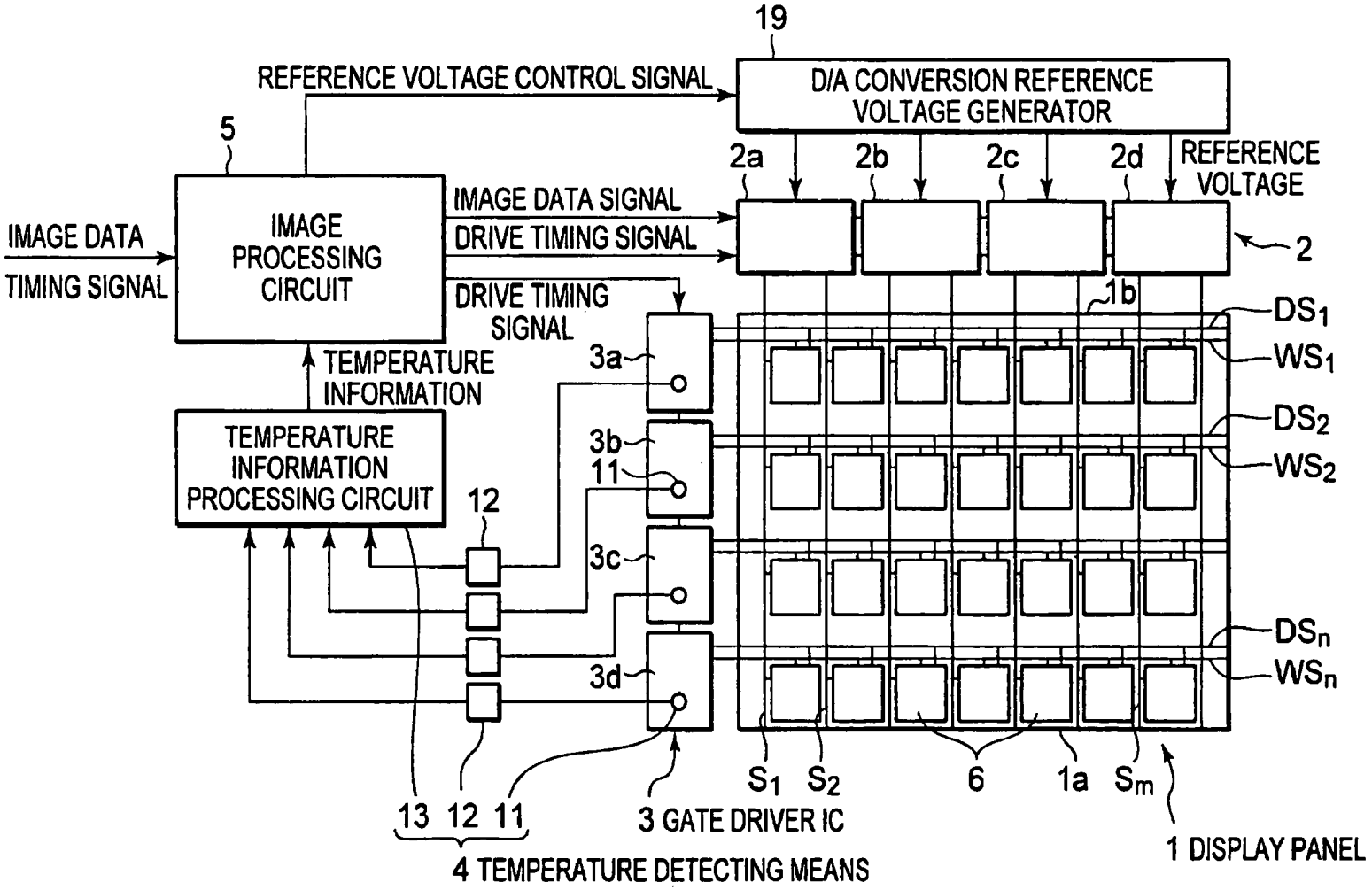
FIG. 1 is a block diagram showing a display device according to a first embodiment of the present invention.

Embodiments of the present invention now will be described with reference to the accompanying drawings. FIG. 1 is a block diagram showing a display device according to an embodiment of the present invention. The display device has a plurality of (a large number of) light emitting elements arrayed in a matrix form, the luminance of each light emitting element being controlled by a current value. The display device has a display panel 1, data driver ICs 2, gate driver ICs 3, a temperature detecting means 4, and an image processing circuit 5. In the following description, organic EL elements are used as light emitting elements.

Figure 2:
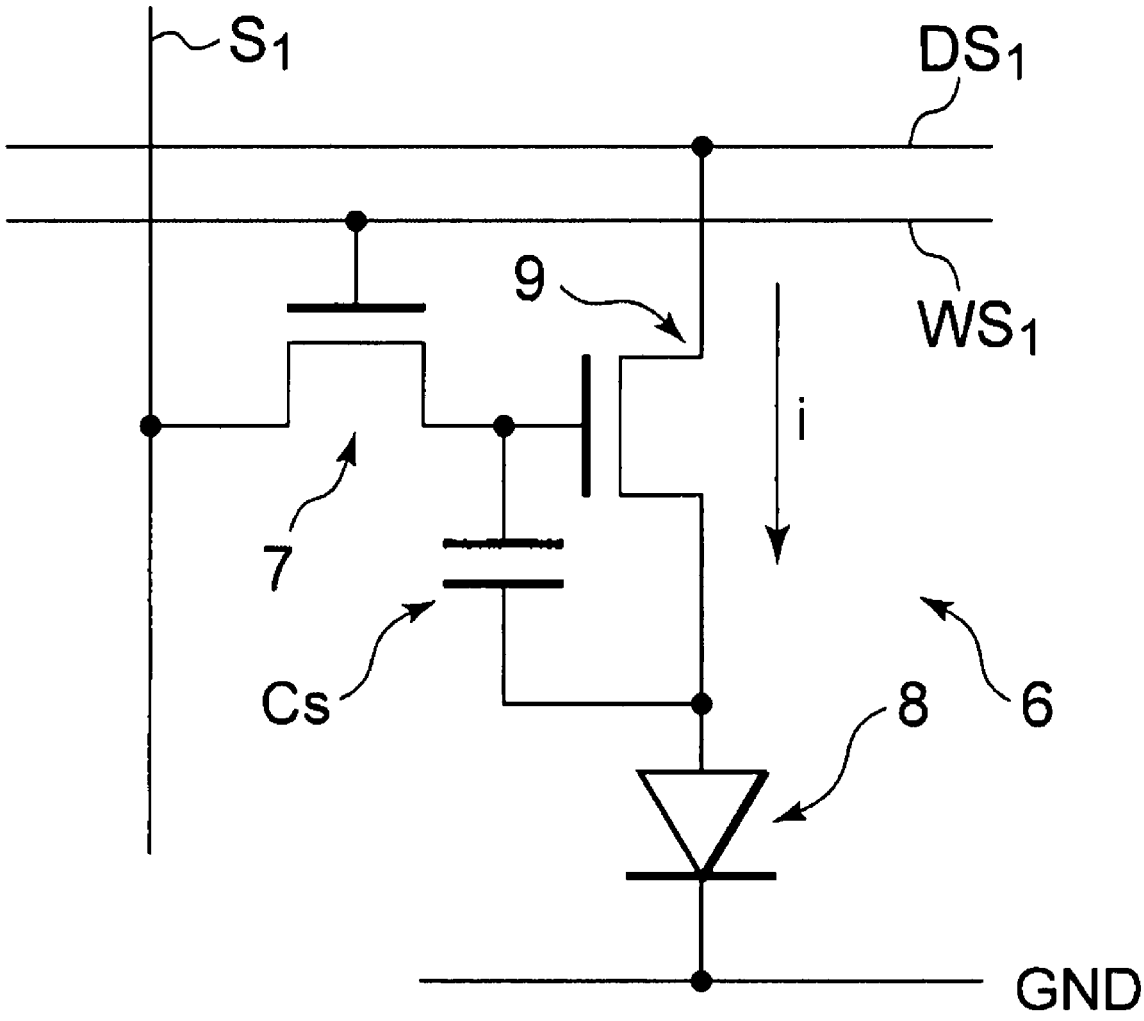
FIG. 2 is a circuit diagram of a pixel circuit formed on a display panel of the display device.
Figure 3:
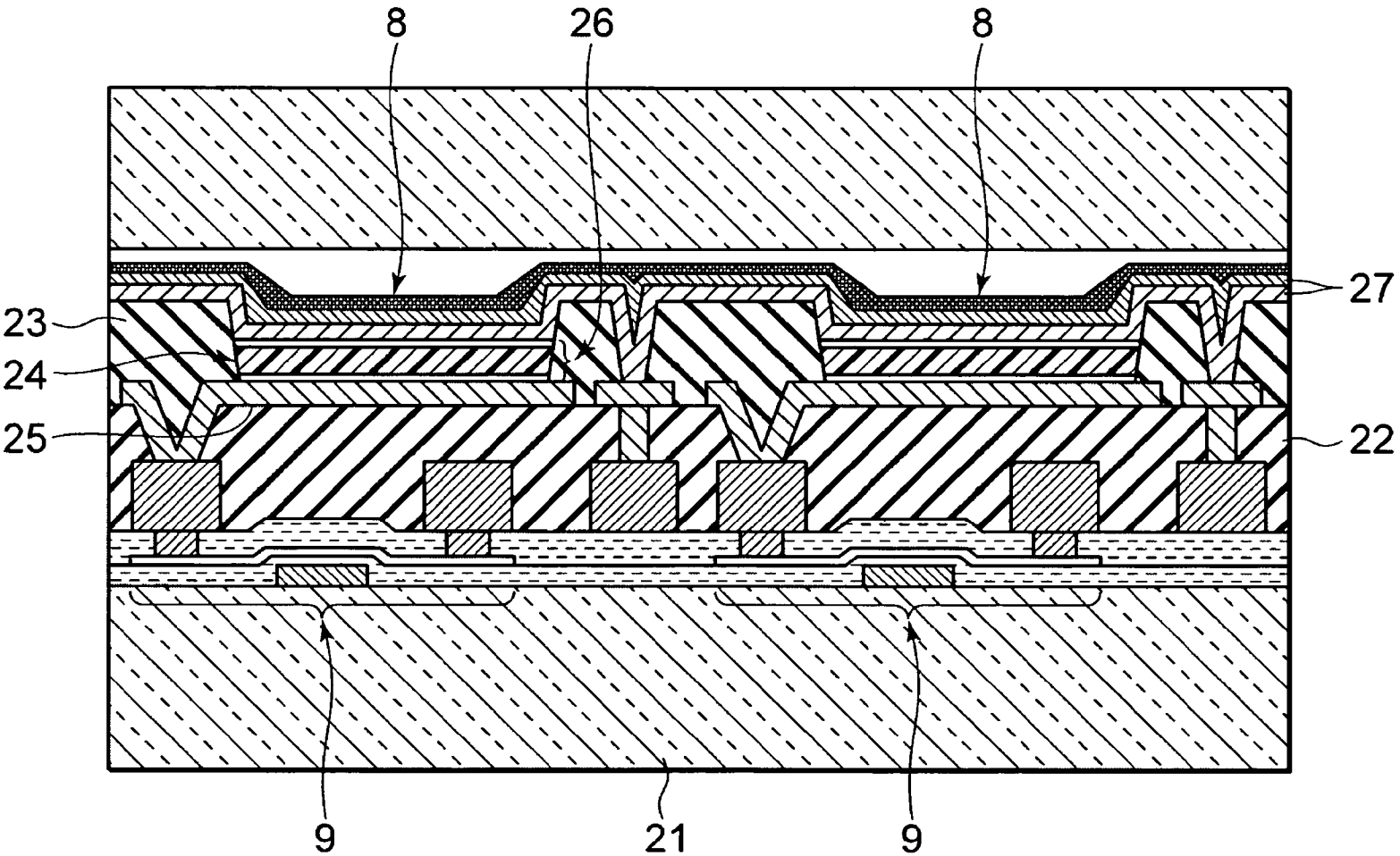
FIG. 3 is a cross sectional view of the pixel circuit.

The display panel 1 has m×n organic EL elements arrayed in a matrix form. A pixel circuit 6 is provided at each cross point between two types of scan lines $WS_1, WS_2, \ldots, WS_n$ and $DS_1, DS_2, \ldots, DS_n$ for selecting organic EL elements of one row from a plurality of organic EL elements, and signal lines $S_1, S_2, \ldots, S_m$ for supplying an image data signal. As shown in FIG. 2, the pixel circuit 6 is composed of: a holding capacitor $C_s$ for holding an image data signal; a N-MOS write transistor 7 driven by a corresponding one of the scan lines $WS_1$ to $WS_n$ and making the holding capacitor $C_s$ hold the image data signal; and a N-MOS pixel transistor 9 for driving an organic EL element 8. As shown in FIG. 3, an insulating film 22 and a window insulating film 23 are formed above a glass substrate 21 formed with the write transistors 7, pixel transistors 9 and the like, and the organic EL element 8 is formed in a recess 24 of the window insulating film 23.

The organic EL element 8 is composed of: an anode electrode 25 made of metal or the like and formed on the bottom of the recess 24 of the window insulating film 23: an organic layer 26 composed of an electron-injecting layer, an electron-transporting layer, a light-emitting layer, a hole-transporting layer, and a hole-injecting layer; and a cathode electrode 27 formed on the organic layer 26 and made of a transparent conductive film or the like formed in common for all pixels. Although the organic layer 26 employs a five-layer structure in the embodiment, there are other multi-layer structures or a simple-layer structure of a light-emitting layer between the anode and cathode. The multi-layer structure includes a two-layer structure composed of a light-emitting layer (electron-transporting layer) and a hole-transporting layer, a three-layer structure composed of an electron-transporting layer, a light-emitting layer, and a hole-transporting layer, or the like.

The organic layer 26 of the organic EL element 8 is formed by sequentially depositing a hole-injecting layer, a hole-transporting layer, an optical-emitting layer, an electron-transporting layer, and an electron-injecting layer on the anode electrode 25. As current flows through the organic layer 26 via the pixel transistor 9 and the anode electrode 25 shown in FIG. 3, light emits while electrons and holes are recombined.

In a specific example of the structure of the pixel circuit 6 of this embodiment, as shown in FIG. 2, the write transistor 7 of the pixel circuit 6 has a gate connected to the scan line $WS_1$, a source connected to the signal line $S_1$ and a drain connected to the gate of the pixel transistor 9. The pixel transistor 9 has a drain connected to the scan line $DS_1$. The holding capacitor $C_s$ is connected across the gate and source of the pixel transistor 9. The organic EL element 8 has an anode connected to the source of the pixel transistor 9 and a cathode connected to ground (GND). Other pixel circuits 6 have similar structures.

The data driver ICs 2 are wired to the signal lines $S_1$ to $S_m$ of the display panel 1. The data driver ICs 2 selectively supply image data signals corresponding to luminance information to the signal lines $S_1$ to $S_m$, and D/A convert and output the image data signals of a digital image at predetermined timings. Each of the data driver ICs 2 is provided for each area of a plurality of areas dividing the display panel 1 along a vertical direction. In FIG. 1, for the purpose of simplicity, four data driver ICs 2*a* to 2*d* are shown.

The gate driver ICs 3 are wired to the scan lines $WS_1$ to $WS_n$ and $DS_1$ to $DS_n$ of the display panel 1. The gate driver ICs 3 selectively drive the two types of scan lines $WS_1$ to $WS_n$ and $DS_1$ to $DS_n$ at predetermined timings and can select the organic EL elements 8 of one row. Each of the gate driver ICs 3 is provided for each area of a plurality of areas dividing the display panel 1 along a horizontal direction, and drives the organic EL elements 8 in each divided area by flowing current therethrough. In FIG. 1, for the purpose of simplicity, four gate driver ICs 3*a* to 3*d* are shown.

The temperature detecting means 4 is provided to allow an exothermic temperature caused by power consumption in each gate driver IC 3 to be detected. The temperature detecting means 4 detects an exothermic temperature of a corresponding one of the gate driver ICs 3*a* to 3*d*, and generates and outputs temperature information for controlling the temperature of the display panel 1. As shown in FIG. 1, the temperature detecting means is composed of: a chip temperature monitor circuit 11 provided in each of the gate driver ICs 3*a* to 3*d*; an A/D converter 12 for converting an analog signal output from the chip temperature monitor circuit 11 into a digital signal and outputting the digital signal as detection data; and a temperature information processing circuit 13 for processing the detection data and outputting the processed data as temperature information. The chip temperature monitor circuit 11 is formed in such a manner that a temperature rise in a thermosensitive unit 15 to be described later becomes approximately equal to a temperature rise in each gate driver IC 3.

With this arrangement, for example, if a supply current i (refer to FIG. 2) to the organic EL element 8 increases in a full white display state, if a power consumption of the gate driver ICs 3 increases, and if the gate driver ICs 3 generate heat and raise their temperatures, then the chip temperature monitor circuits 11 detect exothermic temperatures of the gate driver ICs 3, and process the input detection data to generate temperature information of a plurality of bits. It is therefore possible to detect the power consumption of the gate driver ICs 3 by using the exothermic temperatures of the gate driver ICs 3 as a substitute for the power consumption having a high correlation with the exothermic temperature.

A detection data supplied from each chip temperature monitor circuit 11 is a data of one bit, for example, taking "1" when a temperature is high as compared to a predetermined threshold value and "0" when a temperature is low. Therefore, if four gate driver ICs 3 are used as shown in FIG. 1, the temperature information processing circuit 13 outputs temperature information of four bits. The number of gate driver ICs is not limited to four, but any number may be set. The larger the number, the higher the precision of position information of the display panel 1 along the vertical direction becomes.

Figure 4:
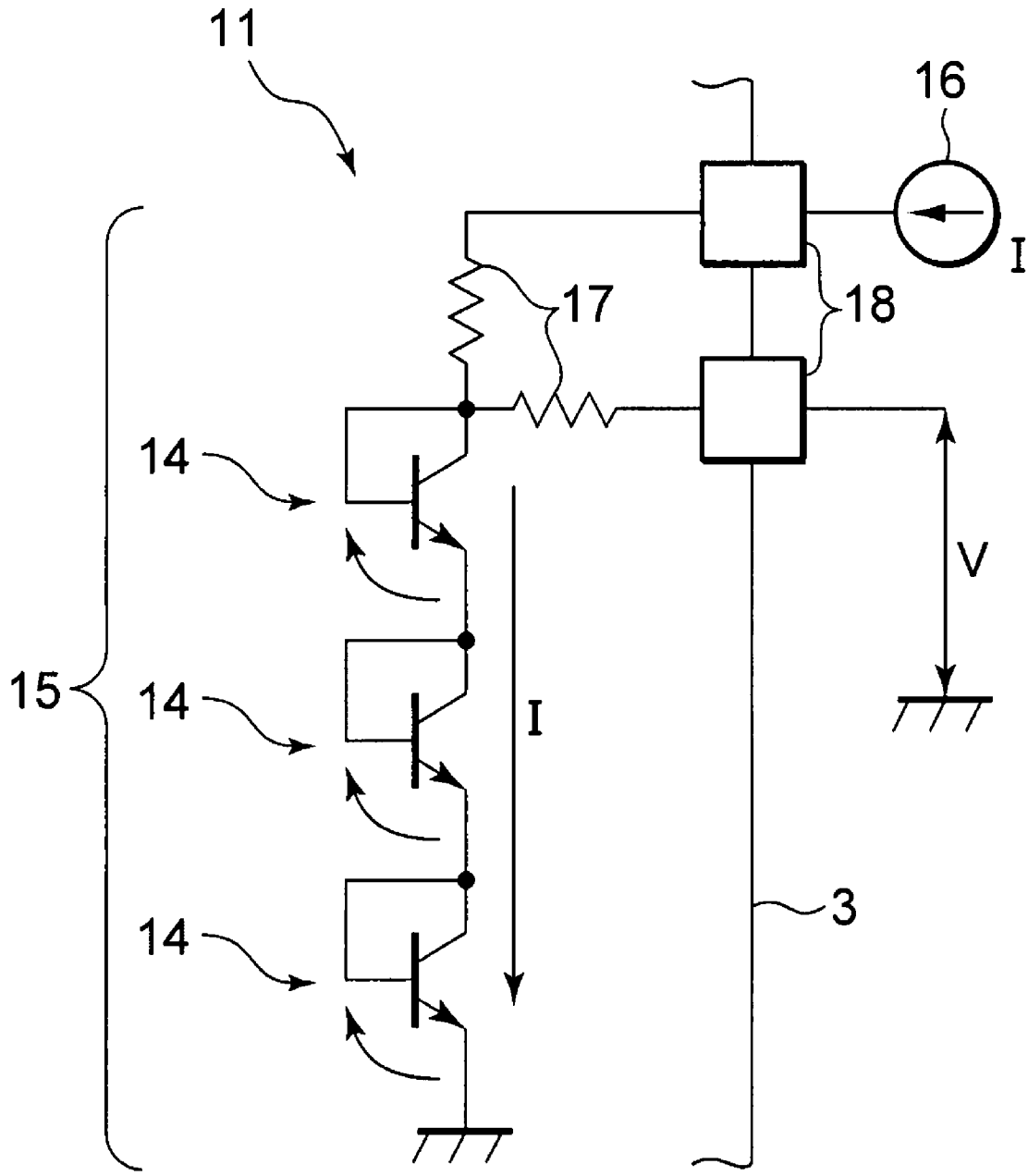
FIG. 4 is a circuit diagram showing an example of the structure of a chip temperature monitor circuit for detecting the temperature of a gate driver IC which drives the pixel circuit.
Figure 5:
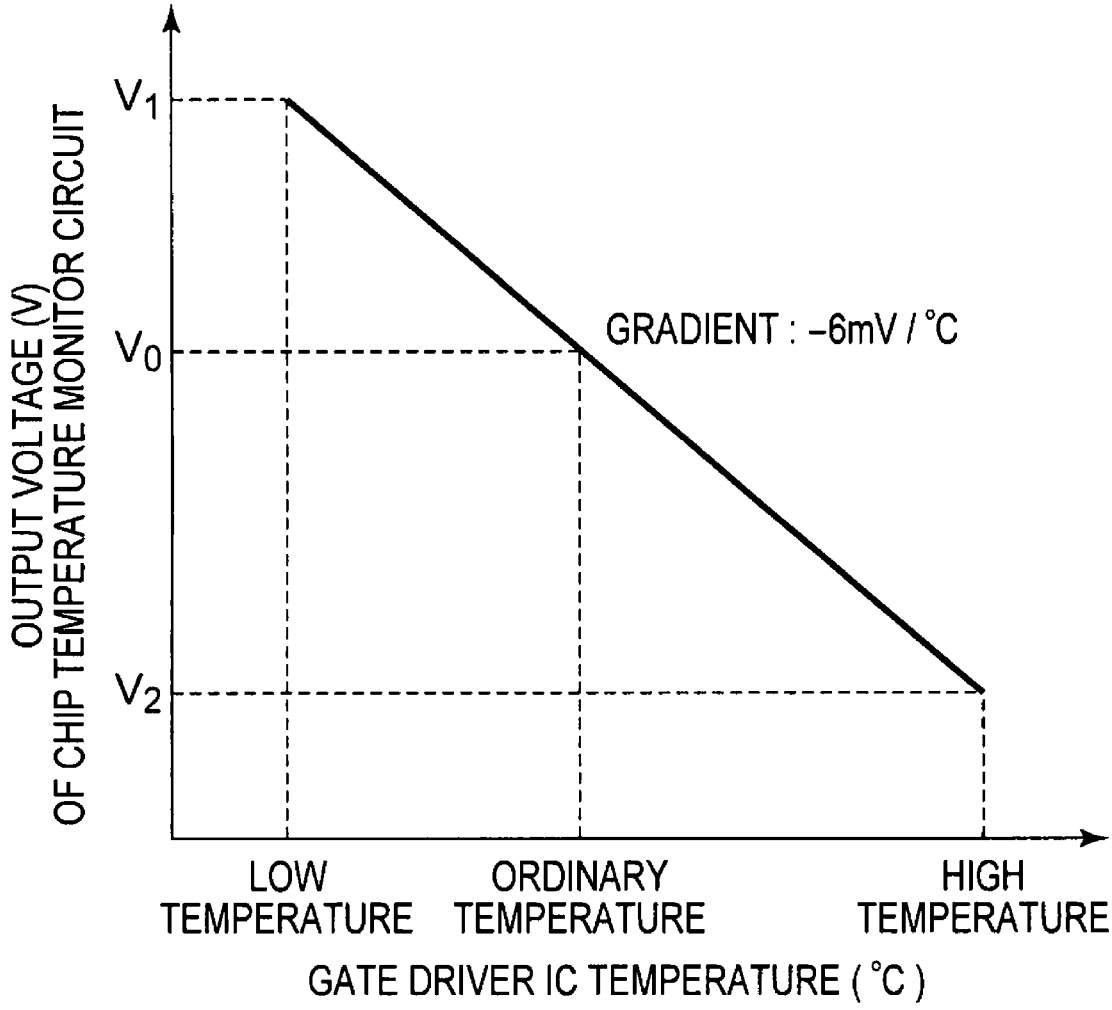
FIG. 5 is a graph showing the temperature characteristics of the chip temperature monitor circuit.

FIG. 4 shows a specific example of the structure of the chip temperature monitor circuit 11. As shown in FIG. 4, in the chip temperature monitor circuit 11, the thermosensitive unit 15 is composed of, for example, a serial connection of a plurality (in FIG. 4, three) of diode-connected PNP transistors 14 with the base and the collector being short circuited. By flowing a constant current I from a constant current source 16, a temperature change in a forward voltage drop of the thermosensitive unit 15 is detected. The forward voltage drop of a PN junction diode is 0.7 V and the temperature characteristic is −2 mV/° C. A serial connection of three PN junction diodes therefore has the temperature characteristic of −6 mV/° C. As shown in FIG. 5, an output, voltage of the chip temperature monitor circuit 11 lowers linearly as the temperature of the gate driver IC 3 rises. In FIG. 4, reference numeral 17 represents a resistor element, and reference numeral 18 represents a terminal electrode.

The image processing circuit 5 is provided being wired to the data driver ICs 2, the gate driver ICs 3 and the temperature detecting means 4. The image processing circuit 5 controls the supply current i to the organic EL elements 8 by comparing the temperature information input from the temperature detecting means 4 with temperature information added with weighted position information, by using a look-up table previously formed and stored. With this weighting, a detection data of an exothermic temperature caused by the power consumption of each gate driver IC 3 is made larger for the gate drive IC 3 in an upper area of the display panel 1. By using the input image data and timing signals, the image processing circuit outputs the image data signals and drive timing signals to the data driver ICs 2 and outputs the drive timing signals to the gate driver ICs 3.

Figure 7:
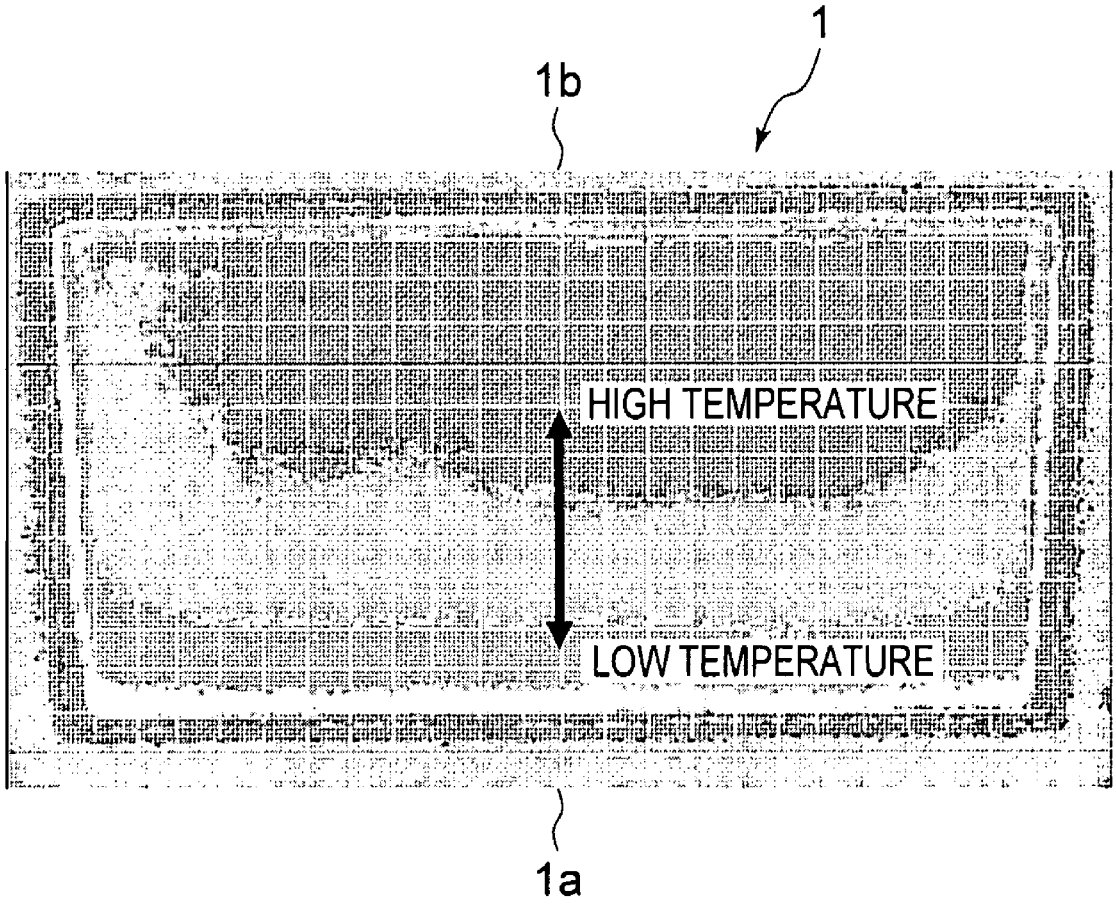
FIG. 7 is an illustrative diagram showing a surface temperature distribution of a large size or high luminance display panel.
Figure 8B:
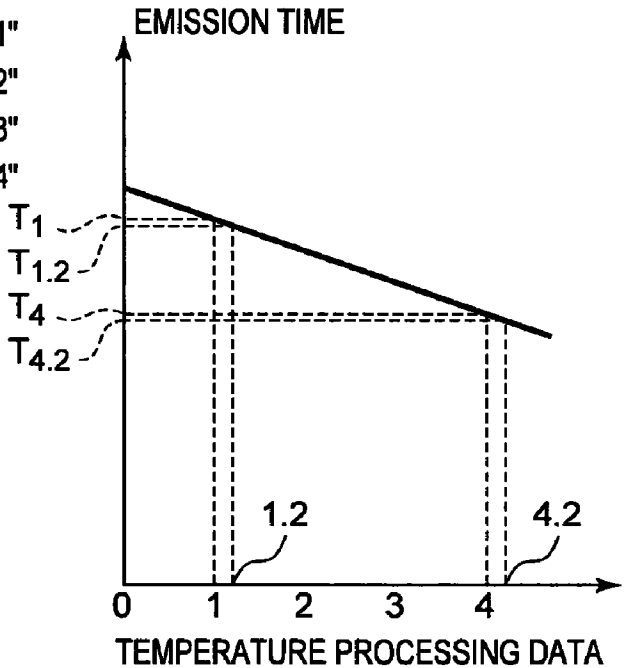
FIGS. 8A and 8B are graphs explaining temperature control of the display panel.
Figure 8A:
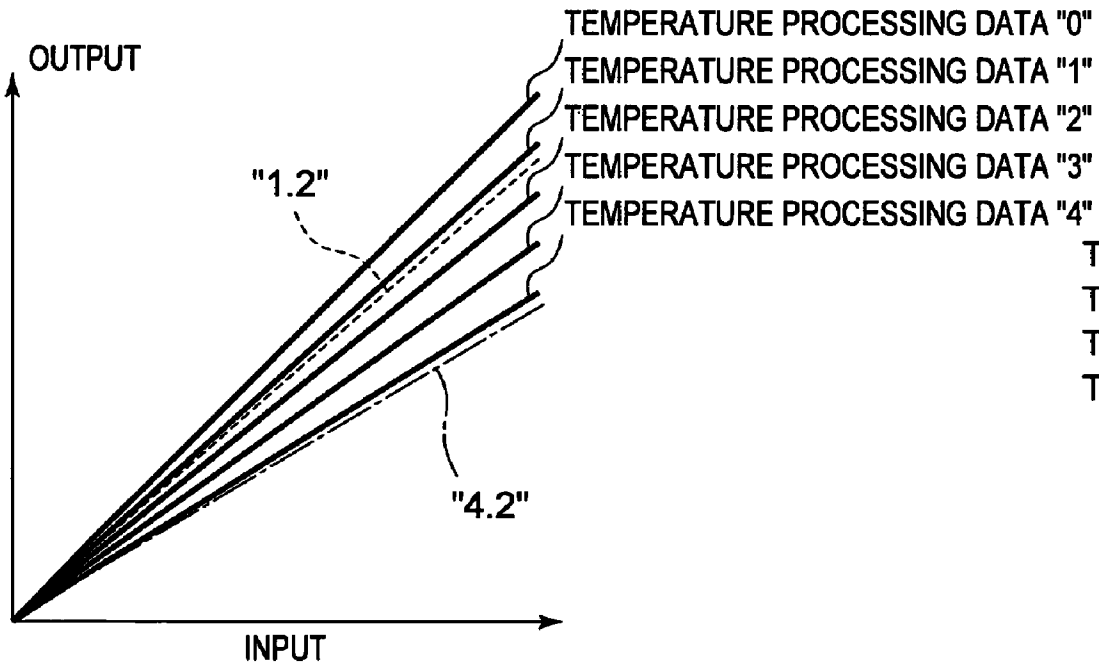

Generally, a large size or high luminance display panel 1 has a tendency in which a surface temperature becomes higher from a lower end 1*a* toward an upper end 1*b*, as shown in FIG. 7. In one embodiment of the present invention, therefore, the image processing circuit 5 has the look-up table previously formed and stored. As shown in FIG. 6, the look-up table stores the temperature information added with the position information for performing weighting in such a manner that a temperature detection data becomes larger from a gate driver IC 3*d* corresponding to a lower area of the display panel 1 toward the gate driver IC 3*a* corresponding to the upper area of the display panel 1, in correspondence with the temperature information of four bits input from the temperature detecting means. By comparing the temperature information of four bits input from the temperature detecting means 4 with the temperature information added with the weighted position information in the look-up table, a corresponding one of temperature processing data (refer to the lowest row in FIG. 6) is selected. In accordance with the selected temperature processing data, the image processing circuit 5 adjusts to lower an amplification factor for input image data, as shown in FIG. 8A, or adjusts an emission time, as shown in FIG. 8B. In this way, it becomes possible to suppress the power consumption of the gate driver ICs 3 and suppress the heat generation of the organic EL elements 8.

In FIG. 1, reference numeral 19 represents a D/A conversion reference voltage generator which is controlled by a reference voltage control signal from the image processing circuit 5 and which generates and outputs a reference voltage to which the data driver ICs 2 D/A convert the digital image data into analog signals.

Next, a description will be given of the temperature control of the display panel 1 of the display apparatus structured as above.

For example, in a full white drive state, a peak current of the drive current i is supplied to all organic EL elements 8 of the display panel 1. Therefore, the power consumption of the gate driver ICs 3 increases and the gate driver ICs generate heat.

Heat generated by the gate driver ICs 3 is detected with the chip temperature monitor circuits 11 of the temperature detecting means 4 provided in the gate driver ICs 3. Namely, a temperature change in a forward voltage drop of the diodes changing with a temperature is detected with each thermosensitive unit 15. Each A/D converter 12 converts an analog signal output from the chip temperature monitor circuit 11 into detection data of one bit, taking "1" when a temperature is high relative to a predetermined threshold value and "0" when a temperature is low. The detection data from each chip temperature monitor circuit 11 is processed and converted by the temperature information processing circuit 13 into temperature information of four bits which is, in turn, output to the image processing circuit 5.

The image processing circuit 5 compares the input temperature information with the look-up table (refer to FIG. 6) to select the temperature processing data. For example, if the input temperature information is "1000", the temperature information added with the weighted position information is "1.2, 0.0, 0.0, 0.0 and the total bit is "1.2", so that the temperature processing data "1.2" is selected from the look-up table shown in FIG. 6.

In this case, for example, if an emission luminance of the organic EL elements 8 is to be lowered by adjusting an amplification factor for the image data, the amplification factors of amplifier circuits are adjusted to obtain the input/output characteristics of the image data corresponding to the temperature processing data "1.2", as shown by a broken line in FIG. 8A. The current i to be supplied to each organic EL element 8 is therefore suppressed, and the luminance of the whole screen of the display panel 1 lowers. At the same time, the heat generation by the organic EL elements 8 is suppressed and the temperature of the display panel 1 is lowered.

If the input temperature information is "1111", the temperature information added with the weighted position information is "1.2, 1.1, 1.0, 0.9" and the total bit is "4.2", so that the temperature processing data "4.2" is selected from the look-up table shown in FIG. 6. In this case, the amplification factors of amplifier circuits are adjusted to obtain the input/output characteristics of the image data corresponding to the temperature processing data "4.2", as shown by an one-dot chain line in FIG. 8A.

Alternatively, an emission luminance of the organic EL elements 8 may be controlled by adjusting the emission time of the organic EL elements 8. In this case, if the input temperature information is "1000", this information is compared with the look-up table shown in FIG. 6 to select the temperature processing data "1.2". By using a look-up table, such as the one shown in FIG. 8B, previously preset, and storing the relation between temperature processing data and an emission time, an emission time of $T_{1.2}$ corresponding to the temperature processing data "1.2" is selected. A pulse width of a scan signal to be supplied to the scan lines $DS_1$ to $DS_n$ of the gate driver IC's 3*a* to 3*d* is narrowed to set the emission time to $T_1$. The effective value of the current to be supplied to each organic EL element 8 is therefore lowered, and the luminance of the whole screen of the display panel 1 is lowered. At the same time, the heat generation of the organic EL elements 8 is suppressed and the temperature of the display panel 1 is lowered.

If the input temperature information is "1111", the temperature processing data "4.2" is selected from the look-up table shown in FIG. 6. In this case, by using the look-up table shown in FIG. 8B, an emission time of $T_{4.2}$ corresponding to the temperature data "4.2" is selected.

As the temperature of the display panel 1 is suppressed and exothermic temperatures of the gate drive ICs 3 are lower and not higher than a reference value, the temperature information output from the temperature detecting means 4 is "0000", and the image processing circuit 5 selects the temperature processing data "0.0, 0.0, 0.0, 0.0" from the look-up table shown in FIG. 6. The image data changes with the normal input/output characteristics corresponding to the temperature processing data "0", and the emission time recovers a normal emission time. The above-described operations are repeated so that the luminance and the temperature of the display panel 1 are maintained in an optimum state.

Figure 9:
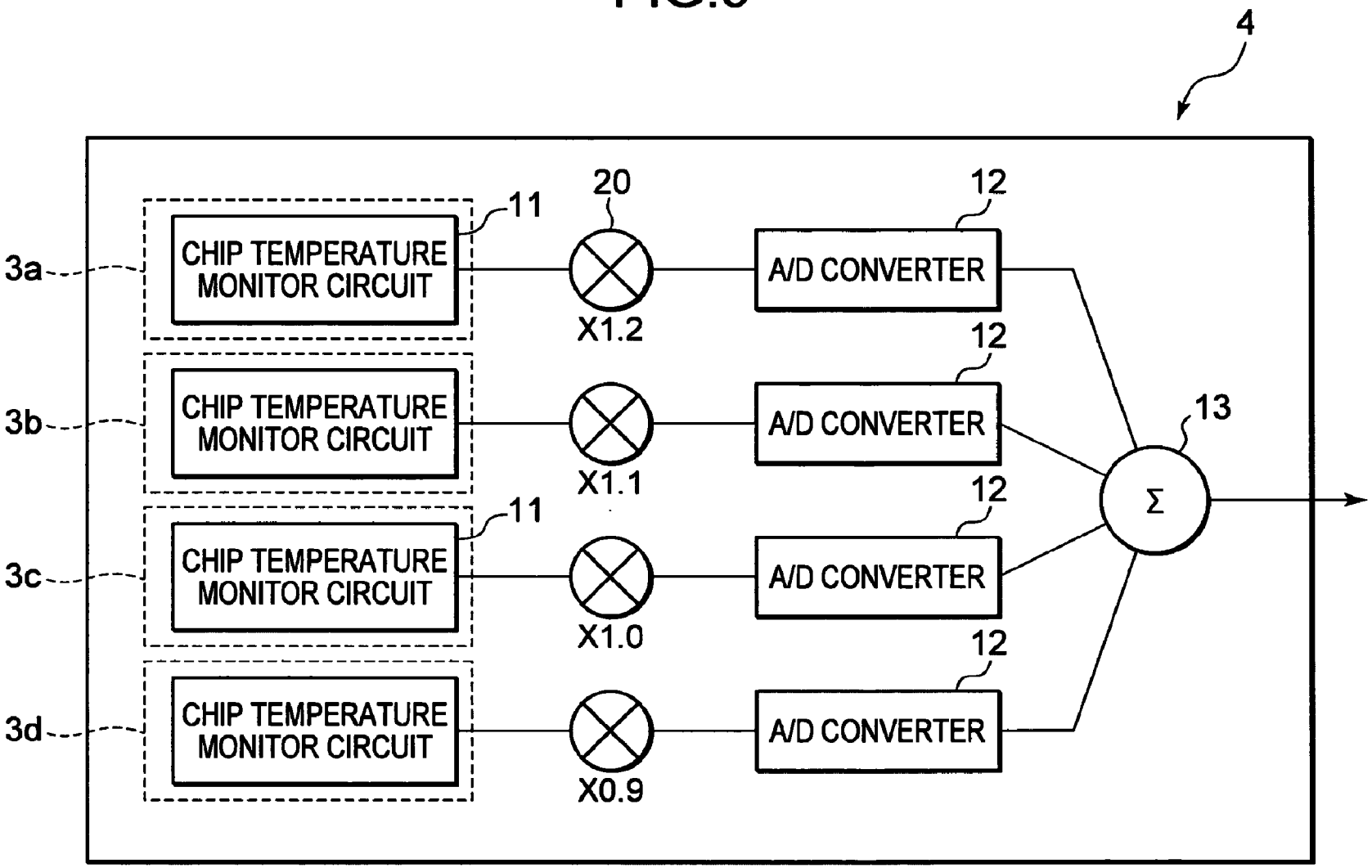
FIG. 9 is a block diagram showing an example of the structure of a temperature detecting means of the display device according to a second embodiment of the present invention.

FIG. 9 is a block diagram showing an example of the structure of a temperature detecting means 4 of the display device according to the second embodiment of the present invention. The display device has the temperature detecting means 4 for obtaining the temperature information added with the weighted position information for performing weighting in such a manner that a temperature detection sensitivity becomes higher for the gate driver IC 3 corresponding to the upper area of the display panel 1 and the image processing circuit 5 for comparing the temperature information added with the weighted position information input from the temperature detecting means 4 with the temperature information in a look-up table previously formed and stored to select the temperature processing data for controlling the supply current i to the organic EL elements 8 and lowering the luminance of the display panel 1 using the temperature processing data.

In the specific structure of the temperature detecting means, a multiplier 20 is inserted between the chip temperature monitor circuit 11 and the A/D converter 12 to amplifier an analog input from the chip temperature monitor circuit 11, so that the temperature detection sensitivity of each chip temperature monitor circuit 11 can be substantially changed by weight coefficients of ×1.2, ×1.1, ×1.0 and ×0.9.

In this case, if the temperature information added with the weighted position information output from the temperature detecting means 4 is "1000", the temperature processing data "1" is selected, as shown in FIG. 10. In this manner, the amplification factors of amplifier circuits are adjusted so that the input/output characteristics of image data shown in FIG. 8A corresponding to the temperature processing data "1" are selected. Alternatively, an emission time $T_1$ corresponding to the temperature processing data "1" shown in FIG. 8B is selected by using the look-up table.

If the temperature information input from the temperature detecting means 4 is "1111", the temperature processing data "4" is selected, as shown in FIG. 10. In this manner, the amplification factors of amplifier circuits are adjusted so that the input/output characteristics of image data shown in FIG. 8A corresponding to the temperature processing data "4" are selected. Alternatively, an emission time $T_4$ corresponding to the temperature processing data "4" shown in FIG. 8B is selected by using the look-up table.

In the embodiments described above, a detection data of each chip temperature monitor circuit 11 is set to one bit. The present invention is not limited thereto, but the detection data may be constituted of a plurality of bits, or an analog value may be output as the detection data. In this case, the precision of temperature information is improved further.

In the embodiments described above, although the temperature control of the display panel 1 is performed by adjusting either the amplification factor for image data or an emission time, the present invention is not limited thereto, and both the amplification factor and emission time may be adjusted.

In the embodiments described above, the chip temperature monitor circuit 11 is provided in the gate driver IC 3. The present invention is not limited thereto, and the chip temperature circuit 11 may be mounted on the surface of the gate driver IC 3. In this case, the chip temperature monitor circuit 11 is not limited to the diode structure changing a forward voltage drop with a temperature. For example, a temperature detector sensor such as a thermo couple may be used.

In the embodiments described above, although the temperature detecting means 4 is used, embodiments of the present invention are not limited thereto, but a consumption power detector circuit may be used which measures a supply current value to the gate driver IC 3 to detect the consumption power of the gate driver IC 3.

In the embodiments described above, although the organic EL elements 8 are used as light emitting elements, the present invention is not limited thereto, and a light emitting element may be any type as long as the luminance is controlled by a current value.

Examples of Applications

The display device of one embodiment of the present invention described above is applicable to various electronic apparatus shown in FIGS. 11 to 15 in all fields, in which a video signal input to an electronic apparatus or generated in an electronic apparatus is displayed as images or pictures, such as a digital camera, a note type personal computer, a portable terminal apparatus, such as a mobile phone, and a video camera. Descriptions will be given of examples of an electronic apparatus to which embodiments of the present invention is applicable.

Figure 11:
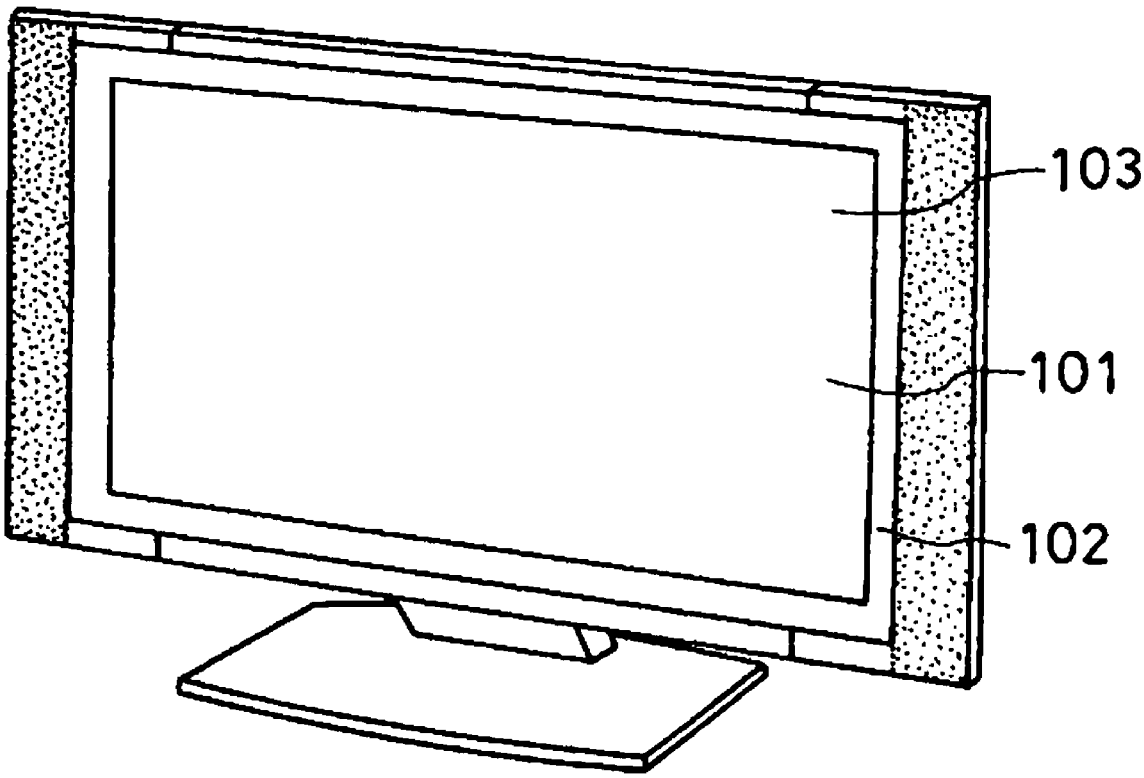
FIG. 11 is a perspective view of a television set applying the display device of one embodiment of the present invention.

FIG. 11 is a perspective view of a television set to which the display device of one embodiment of the present invention is applied. The television set of this application example has an image display screen 101, a front panel 102, a filter glass 103 and the like. The image display screen 101 is formed by using the display device of the present invention.

Figure 12A:
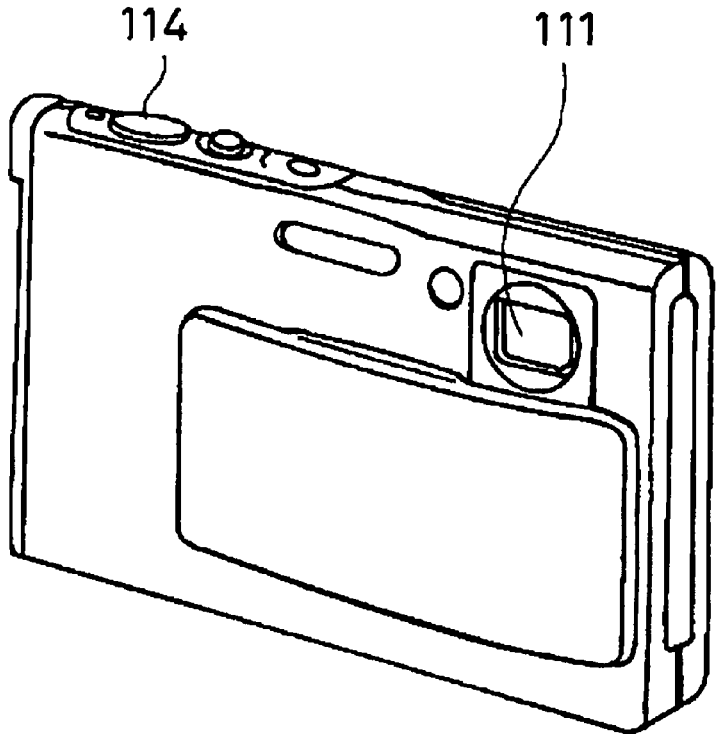
FIG. 12 is a perspective view of a digital camera applying the display device of one embodiment of the present invention.
Figure 12B:
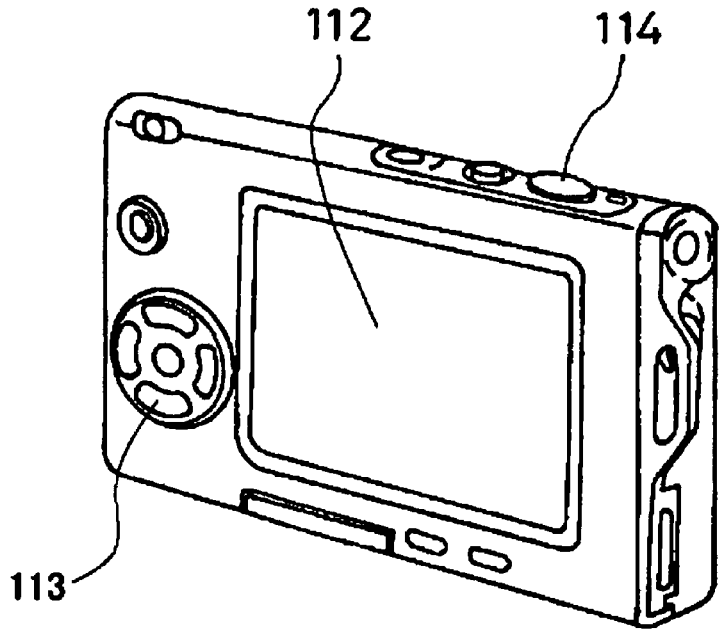

FIGS. 12A and 12B are perspective views of a television set to which the display device of one embodiment of the present invention is applied; FIG. 12A is a perspective view as viewed from the front side; and FIG. 12B is a perspective view as viewed from the back side. The digital camera of this application example has a taking lens 111, a display unit 112, a menu switch 113, a shutter button 114 and the like. The display unit 112 is formed by using a display device of one embodiment of the present invention.

Figure 13:
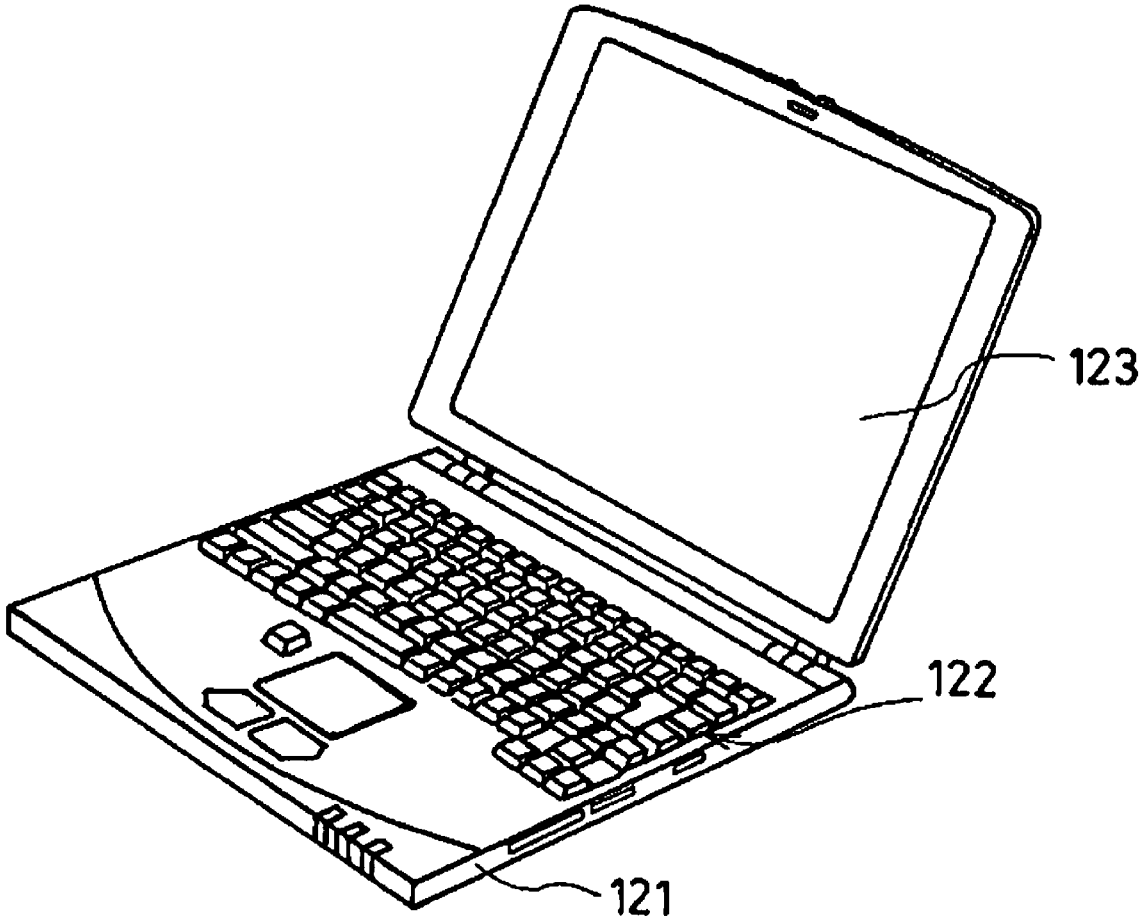
FIG. 13 is a perspective view of a note type personal computer applying the display device of one embodiment of the present invention.

FIG. 13 is a perspective view of a note type personal computer to which the display device of one embodiment of the present invention is applied. The note type personal computer of this application example has a main unit 121, a keyboard 122 to be used for entering characters and the like, a display unit 123 for displaying an image, and the like. The display unit 123 is formed by using a display device of one embodiment of the present invention.

Figure 14:
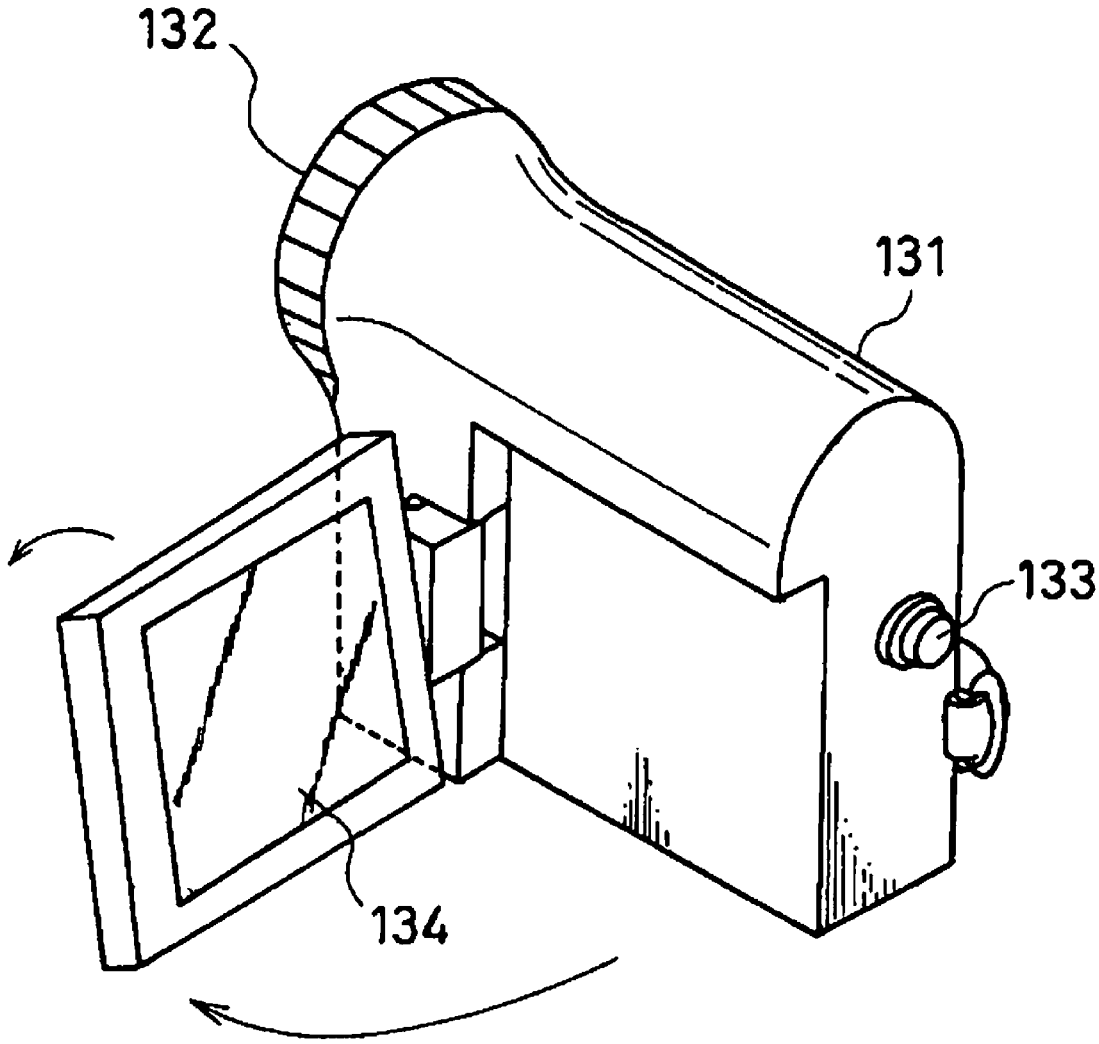
FIG. 14 is a perspective view of a video camera applying the display device of one embodiment of the present invention.

FIG. 14 is a perspective view of a video camera to which the display device of one embodiment of the present invention is applied. The video camera of this application example has a main unit 131, a lens 132 mounted on the front side for taking an object, a start/stop switch 133 to be used during photographing, a display unit 134 and the like. The display unit 134 is formed by using a display device of one embodiment of the present invention.

Figures 15A, 15B, 15C, 15D, 15E, 15F, 15G:
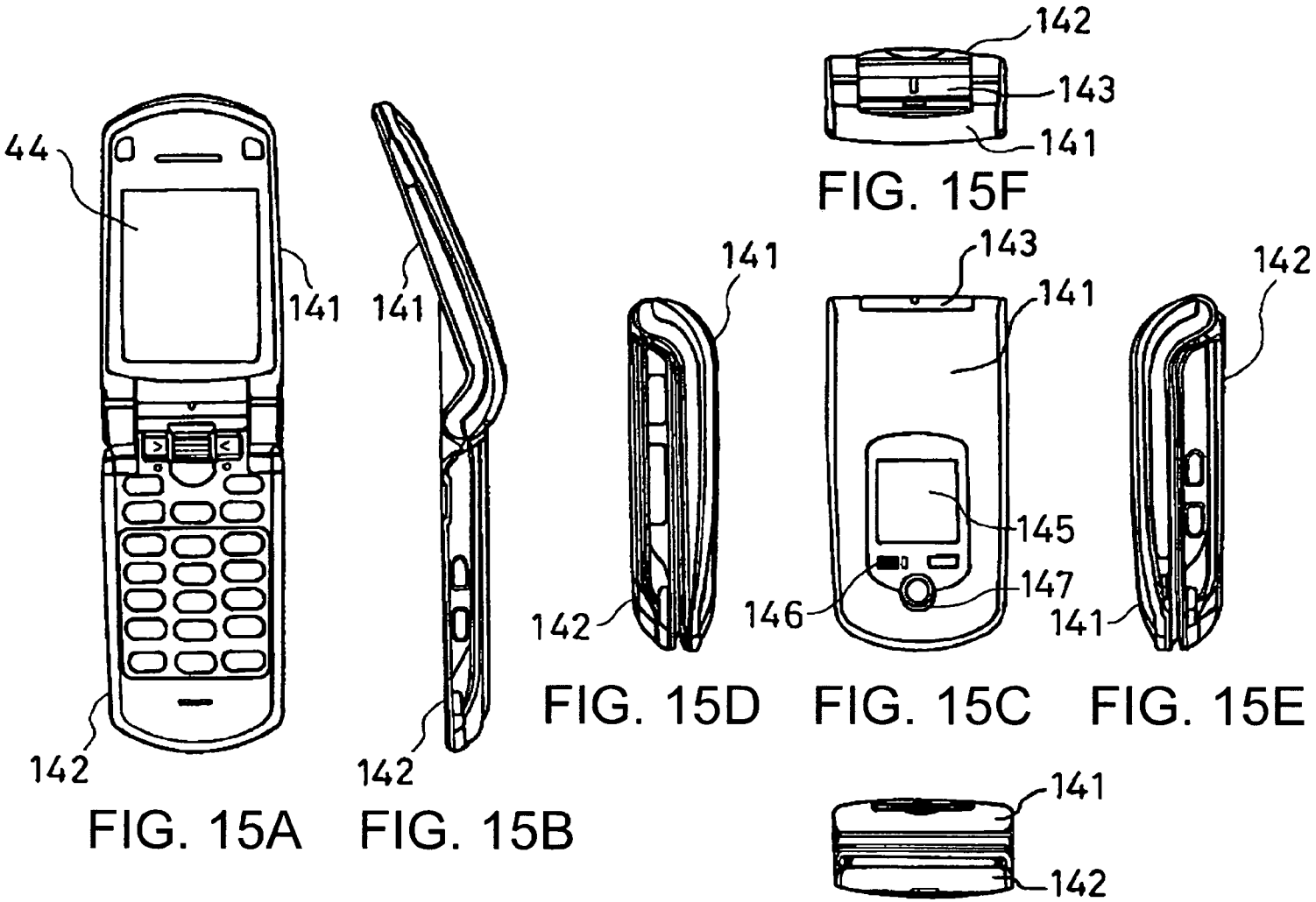
FIGS. 15A to 15G are illustrative diagrams of a portable terminal apparatus applying the display device of one embodiment of the present invention.

FIGS. 15A to 15G show a portable terminal apparatus, e.g., a mobile phone, to which a display device of one embodiment of the present invention is applied. FIG. 15A is a front view in an open state; FIG. 15B is a side view; FIG. 15C is a plan view in a close state; FIG. 15D is a left side view of FIG. 15C; FIG. 15E is a right side view of FIG. 15C; FIG. 15F is a back view of FIG. 15C; and FIG. 15G is a front view of FIG. 15C. The mobile phone of this application example has an upper housing 141, a lower housing 142, a coupling unit (hinge unit) 143, a display 144, a subdisplay 145, a picture light 146, a camera 147 and the like. The display 144 and the subdisplay 145 are formed by using the display device of one embodiment of the present invention.

It should be understood by those skilled in the art that various modifications, combinations, subcombinations and alternations may occur depending on design requirements and other factors insofar as they are within the scope of the appended claims or the equivalents thereof.

The present application claims benefit of priority of Japanese Patent Application No. 2006-341064 filed in the Japanese Patent Office on Dec. 19, 2006, the entire content of which are incorporated herein by reference.

What is claimed is:

1. A temperature controlling method for a display device, the method comprising the steps of:

generating temperature information indicating a rise in temperature of each of a plurality of driver ICs of the display device added with weighted position information for the plurality of driver ICs for performing weighting in such a manner that detection data of the rise in temperature caused by consumption of power of the driver ICs becomes larger for driver ICs corresponding to an upper area of the display panel; and controlling a drive current to each of a plurality of light emitting elements of the display device by comparing the temperature information added with the weighted position information to temperature information in a look-up table previously formed and stored, wherein the step of generating the temperature information of the driver ICs is performed by detecting a rise in temperature of the driver ICs by detecting a rise in temperature in a thermosensitive unit provided in each of the driver ICs.

2. The temperature controlling method according to claim 1, wherein the step of generating the temperature information of the driver ICs is further includes a step of detecting a consumption of power of each of the driver ICs in a consumption power detector circuit provided in a drive current input portion.

3. A display device comprising:

a display panel having a plurality of light emitting elements arrayed in a matrix form, the display panel being divided into at least a first display area and a second display area;

a first driver IC that provides a first drive current to light emitting elements of the first display area and a second driver IC that provides a second drive current to light emitting elements of the second display area;

detecting means for generating temperature information indicating a rise in temperature of the first and the second driver ICs added with weighted position information for the first and the second display areas for performing weighting based on the relative position of the first display area and the second display area; and an image processing circuit for controlling the first drive current and the second drive current based on a comparison of the temperature information added with the weighted position information to the temperature information in a look-up table previously formed and stored, wherein the detecting means includes a thermosensitive unit provided in each of the driver ICs for detecting a rise in temperature of the driver ICs.

4. The display device according to claim 3, wherein the thermosensitive unit has a diode structure changing a forward voltage drop with a temperature.

5. The display device according to claim 3, wherein the detecting means further includes a consumption power detecting circuit in a drive current input portion of the driver IC.

6. The display device according to claim 3, wherein the image processing circuit controls a drive current to the light emitting elements by controlling an amplification factor for image data of the light emitting elements.

7. The display device according to claim 3, wherein the light emitting elements are organic electro luminescence element.

8. The display device according to claim 3, wherein the image processing circuit controls a drive current to the light emitting elements by controlling an emission time of the light emitting elements.

9. The display device according to claim 3, wherein the first display area is a first row of the light emitting elements arrayed in the matrix form and the second display area is a second row of the light emitting elements arrayed in the matrix form.

10. The display device according to claim 3, wherein the first display area is in an upper portion of the display panel and the second display area is in a lower portion of the display area, and weighting of the generated temperature information is performed in such a manner that detection data of the rise in temperature of the first driver IC becomes larger compared to detection data of the rise in temperature of the second driver IC.

11. A temperature controlling method for a display device, the method comprising the steps of:

generating detected temperature information for a plurality of driver ICs of the display device, the detected temperature information being generated by detecting a rise in temperature of each of the driver ICs;

generating weighted temperature information by weighting the detected temperature information with weighted position information, the weighted position information being previously formed and stored in a look-up table, the weighted temperature information being generated such that the detected temperature information is increased for a portion of the driver ICs that correspond to an upper area of a display panel of the display device; and controlling a drive current to each of the light emitting elements based on the weighted temperature information, wherein the step of generating detected temperature information of the driver ICs is performed by detecting a rise in temperature of the driver ICs by detecting a rise in temperature in a thermosensitive unit provided in each of the driver ICs.

12. The temperature controlling method according to claim 11, wherein the step of generating detected temperature information of the driver ICs further includes a step of detecting a consumption of power of each of the driver ICs in a consumption power detector circuit provided in a drive current input portion.

13. The temperature controlling method according to claim 11, wherein, in the step of generating detected temperature information for the plurality of driver ICs, each of the driver ICs provides a drive current to a row of a plurality of light emitting elements, the light emitting elements being arrayed in a matrix form.

14. The temperature controlling method according to claim 1, wherein, in the step of generating temperature information, each of the driver ICs provides a drive current to a row of a plurality of light emitting elements, the light emitting elements being arrayed in a matrix form.

15. A display device comprising:

a display panel having a plurality of light emitting elements arrayed in a matrix form, the display panel being divided in a horizontal direction into a plurality of display areas;

a plurality of driver ICs, each of the driver ICs corresponding to one of the display areas and each of the display areas receiving an area drive current from one of the corresponding driver ICs;

first generating means for generating detected temperature information for the plurality of driver ICs of the display device, the detected temperature information being generated by detecting a rise in temperature of each of the driver ICs, the rise in temperature of each of the driver ICs being caused by consumption of power of each of the driver ICs;

second generating means for generating weighted temperature information by weighting the detected temperature information with weighted position information, the weighted position information being previously formed and stored in a look-up table, the weighted temperature information being generated such that the detected temperature information is increased for a portion of the driver ICs that correspond to an upper area of a display panel of the display device; and an image processing circuit configured to control the drive current to each of the light emitting elements based on the weighted temperature information, wherein the first generating means includes a thermosensitive unit provided in each of the driver ICs for detecting a rise in temperature of the driver ICs.

16. The display device according to claim 15, wherein the thermosensitive unit has a diode structure changing a forward voltage drop with a temperature.

17. The display device according to claim 15, wherein the first generating means includes a consumption power detecting circuit in a drive current input portion of the driver IC.

18. The display device according to claim 15, wherein the controller is configured to control the drive current to each of the light emitting elements by controlling an amplification factor for image data of the light emitting elements.

19. The display device according to claim 15, wherein the controller is configured to control the drive current to each of the light emitting elements by controlling an emission time of the light emitting elements.

20. The display device according to claim 15, wherein the light emitting elements are organic electro luminescence elements.

21. The display device according to claim 15, wherein each display area is a row of the light emitting elements arrayed in the matrix form.

* * * * *